United States Patent [19]

Key, Jr.

[11] 3,990,378

[45] Nov. 9, 1976

[54] GATING MEANS FOR TORPEDO ACOUSTIC HOMING SYSTEMS

[75] Inventor: Carroll L. Key, Jr., State College, Pa.

[73] Assignee: The United States of America as represented by the Secretary of the Navy, Washington, D.C.

[22] Filed: Jan. 13, 1958

[21] Appl. No.: 708,736

[52] U.S. Cl. ..... 114/20 R

[51] Int. Cl.[2] ..... F42B 19/06; F42B 19/10; F42B 19/01

[58] Field of Search ..... 114/20–25; 343/100.7, 5 G, 115, 117.1, 16.1, 117, 119, 16, 100, 116

[56] References Cited

UNITED STATES PATENTS

| | | | |
|---|---|---|---|
| 2,166,991 | 7/1939 | Guanella | 343/100.7 UX |
| 2,268,587 | 1/1942 | Guanella | 343/100.7 UX |
| 2,398,421 | 4/1946 | Frische et al. | 343/117.1 UX |
| 2,419,970 | 5/1947 | Roe et al. | 343/117.1 UX |
| 2,423,885 | 7/1947 | Hammond | 350/83.3 |
| 2,497,129 | 2/1950 | Liston | 250/83.3 |
| 2,557,869 | 6/1951 | Gloess | 343/11 |
| 2,715,995 | 8/1955 | Wirkler | 343/100.7 UX |

*Primary Examiner*—Samuel W. Engle
*Assistant Examiner*—Thomas H. Webb
*Attorney, Agent, or Firm*—R. S. Sciascia; Henry Hansen

[57] ABSTRACT

In a detection system for torpedoes providing a first output signal dependent upon target direction relative to the torpedo wherein the target is swept at least initially the combination comprising: movable means actuated by said first output signal for providing an output function proportional to target angle from a reference and to signal-to-noise ratio and having a predetermined power spectrum during the time the target is being swept; first means actuated by said movable means for producing a varying electric signal proportional to said output function; fiter means for receiving said varying electric signal and having a fixed high pass for passing substantially only those frequencies within said power spectrum thereby to filter substantially all undesirable noise signals and amplifier means connected to said filter means for receiving the output thereof, and amplitude detector means connected to the output of said amplifier means to gate upon the reception of a pre-determined level of signal.

4 Claims, 6 Drawing Figures

CARROLL L. KEY, Jr.

INVENTOR.

BY

G. W. O'Brien
V. C. Muller
ATTORNEYS

CARROLL L. KEY, Jr.

INVENTOR.

BY

G. W. O'Brien
V. C. Muller
ATTORNEYS

GATING MEANS FOR TORPEDO ACOUSTIC HOMING SYSTEMS

This invention relates to acoustic homing sysems for torpedoes and more particularly to gating means for torpedo acoustic homing systems for determining when a frequency spectrum contains a desired signal.

One of the fundamental limitations to greater range performance of a torpedo acoustic homing system has been the presence of noise or spurious signals in the signal received by the torpedo. Heretofore the acoustic homing system in a torpedo could not be actuated until the signal-to-noise ratio was relatively large. Actuations of such systems for certain well-known purposes are generally obtained by means of an electronic gate wherein the desired portion of the output signal of a target angle measuring panel, when sufficiently greater than background, is converted to a D.C. voltage and compared in a diode or the like with a D.C. reference voltage of fixed magnitude, actuation being obtained when the former is greater than the latter. Such prior art gates are entirely electronic and operate on the principle of a target signal causing the generation or selection of a D.C,. voltage, this voltage causing the panel to gate when it goes above a predetermined level. In addition to the fact that such an arrangement prohibited gating until the target signal was about equal to or greater than background, which limitation required a relatively short distance (of about 1500 yards or less) between the torpedo and its target before it could be met, variations of the D.C. reference voltage caused variations in the signal level required for gating and quite often pure noise could and did cause the panel to gate. In addition to being sensitive to D.C. drift, as described hereinabove, the response of such prior art gates were not optimized with respect to the signal-to-noise ratio.

It is an object of this invention to provide novel means for actuating a torpedo acoustic homing system.

Another object of this invention is to provide in a torpedo acoustic homing system novel actuating means that is optimized with respect to signal-to-noise ratio and that minimizes the effect of D.C. drift.

A further object of this invention is the provision in a torpedo acoustic homing system of a gate which is based on the principle of generating an A.C. signal proportional to signal-to-noise ratio.

It is another object of this invention to provide in a torpedo acoustic homing system an A.C. differential gate.

These and other objects and features of the invention, together with their incident advantages, will be more readily understood and appreciated from the following detailed description of the preferred embodiment thereof selected for purposes of illustration and shown in the accompanying drawings, in which.

Figure 1:
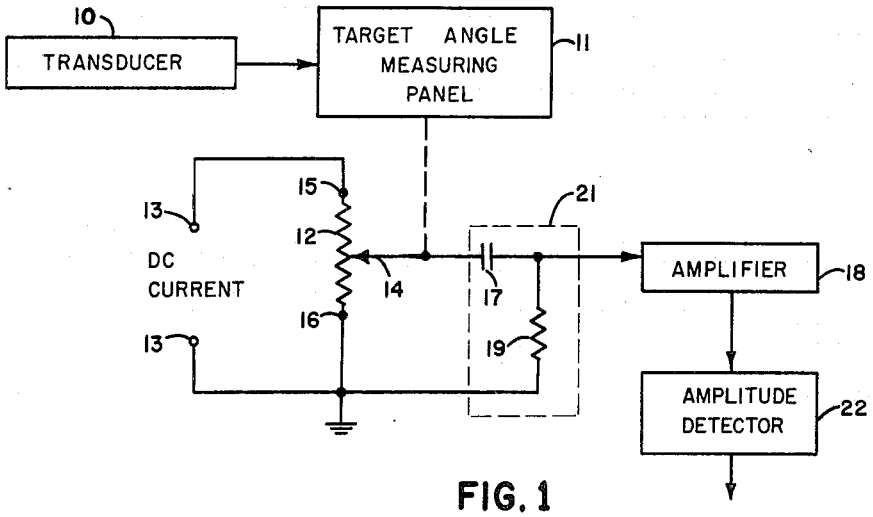
FIG. 1 is a schematic representation, partially in block form, of the novel actuating means.

Referring now to FIG. 1, there is shown a simple circuit illustrating the invention which is described with reference to a torpedo acoustic homing system in order to more clearly present the invention.

In FIG. 1 there is shown a conventional split beam transducer 10 which receives signals containing noise and other undesirable background signals either emanating or reflected from the target. These signals are transmitted to a target angle measuring panel or equipment 11, which provides a voltage or voltages proportional to target position from a reference, generally a plane passing through the longitudinal axis of the torpedo.

Methods and means for obtaining signals proportional to target position or angle are well known in the torpedo and radar arts and therefore will not be explained in detail. Briefly, however, the specific and preferred embodiment described herein contemplates the use of a split beam hydrophone 10 (passive) having, for example, at least a horizontal conventional sum pattern and a difference pattern obtained in the conventional manner. The target angle measuring panel or equipment 11 utilizes cross-correlation techniques and a follow-up system output to provide an angular shaft position $\theta_o$ which is, for a given signal-to-noise ratio, proportional to a target Angle A and in a direction determined by A. By use of correlation techniques, noise and undesirable signals in the sum and difference channels are not correlated while the target signal in the two channels are correlated and in combination with the present invention are used to detect target signals which have a low signal-to-noise ratio as compared to that necessary in the prior art. Panel 11 and transducer 10 in conjunction with which the present device operates, are not claimed as a portion of the present invention but are given by way of example only. Other devices providing an angular shaft position related to target angle can be used as well. The mechanism of U.S. Pat. No. 2,166,991, by Guanella is such an example.

In practice, transducer 10 consists of an array of magnetostrictive elements (not shown) arranged in a square configuration. Each magnetostrictive element has windings of the proper number of turns to produce the required beam pattern. A voltage derived from the electroacoustic effect, in the windings of all of the array elements in series, is frequently designated as the sum-signal voltage or sum voltage, while a difference-signal voltage or difference voltage originates from the respective series windings voltages of elements on, say, the right side of the array electrically subtracted from those on the left side of the array.

In operation, when a plane acoustic wave approaches the face of transducer 10, the voltage from the first responding transducer elements (not shown) to the wave will lead the voltage of the next elements to respond. The sense of direction of the target, right or left, with respect to the transducer 10 centerline can be determined by the phase relationship of the difference voltage to the sum voltage. Since the difference voltage bears a plus or minus 90° phase relationship to the sum voltage, for left or right target angles respectively, if the sum voltage is shifted 90° and phase compared to the difference voltage, the sense of direction (left or right) of the target from the centerline of transducer 10 can be determined. The sum-pattern voltage is constant with respect to the target angle A. The ideal difference-pattern voltage has a constant slope relationship to A. Under these conditions the magnitude of the target angle is determined by the ratio of the difference voltage with respect to the sum voltage.

In operation, the sum voltage from transducer 10 is phase delayed 90° bringing it into phase with the difference voltage. This phase delayed voltage is fed into a phase inverter (not shown) coupled to a variable feedback potentiometer (not shown) in such a manner that the potentiometer arm can select voltages with a phase angle of 0° or 180°, with respect to the difference voltage and in any magnitude from zero to the maximum of the phase delayed voltage. This potentionmeter output voltage is added to the difference voltage fromm the transducer 10 in a summing network (not shown) to obtain an error voltage. This error voltage is fed through a limiting device (not shown), to limit the required dynamic range and thence to a multiplier or phase-sensitive detector (not shown). The sum voltage is also fed through a second limiting device (not shown) to the phase-sensitive detector and compared with the phase angle of the error voltage. When these voltages are correlated, the phase-sensitive detector actuates servo equipment (not shown) which drives the feedback potentiometer arm in such a direction as to cause the error voltage to approach zero. (In general, torpedo self-noise in the sum and difference channels is not correlated, whereas the target signals are.)

Thus the output from the phase-sensitive detector positions a servo-driven shaft (not shown) that, in turn, actuates the feedback potentiometer arm to select a voltage of varying magnitude with 180° phase relationship to the difference voltage. The maximum voltage output of this feedback potentiometer is the voltage level in the sum channel. The voltae on the arm of the potentiometer is fed to the summing network, and the output shaft of the potentiometer rotated until the sum voltage fed into the summing network is sufficient to cause zero error voltage. This zero error voltage causes zero output from the phase-sensitive detector and the servo mechanism driving the shaft, ceases to turn. Thus the system has reached balance. Thus, for the case of infinite signal-to-noise ratio, the shaft angle will be at its maximum value when the voltage in the difference channel is the same as the voltage in the sum channel and will be at 50% of its maximum value when the difference voltage is half that of the voltage of the sum channel. The position of the shaft is proportional to the target angle for any given signal-to-noise ratio. Potentiometer arm 14, of the present invention, is connected to the shaft of the above-described feedback potentiometer.

A potentiometer 12 is connected across a source of D.C. current 13 and is provided with a movable arm 14 normally disposed electrically midway between the positive and negative terminals 15–16 of the potentiometer 12. The potentiometer arm 14 may be mechanically driven in any suitable manner (represented by the dotted line in FIG. 1) by the output signal of the target angle measuring panel 11, such as for example by a servomotor, to provide an angular shaft position $\phi_o$. The shaft position of the arm 14 is deterined by the two functions, (1) the target angle and (2) the signal-to-noise ratio. The precise manner of positioning of arm 14 is indicated on the curves of FIG. 2 and in the subsequent explanation of that figure. A capacitor 17 is connected between the potentiometer arm 14 and a conventional amplifier 18 and in combination with a resistance 19 connected to ground forms a simple high-pass filter 21 and also isolates the amplifier 18 from the D.C. voltage on the potentiometer arm 14 as and for the purposes hereinafter described. A conventional amplitude detector 22 receives the output signal of the amplifier 18 and may function as a gate to obtain a specific result such as, for example, to indicate detection of a target, the direction of a target with respect to a specific reference, or to vary the course or search pattern of a torpedo toward the target.

With the foregoing understanding of the elements and their organization, the operation and novel aspects of this invention will be readily understood from the following explanation.

Figure 2:
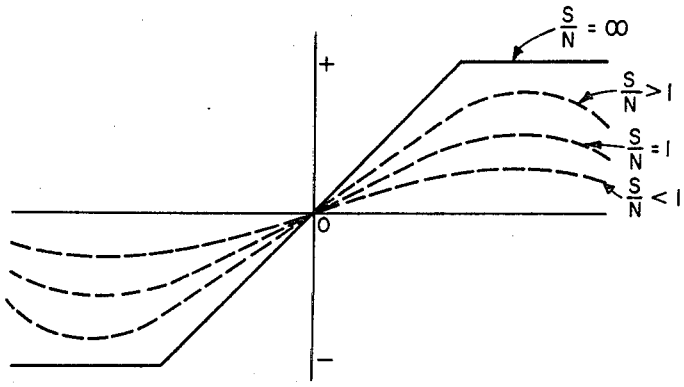
FIG. 2 is a graphic representation of output functions of the target angle measuring panel or equipment.
Figure 4:
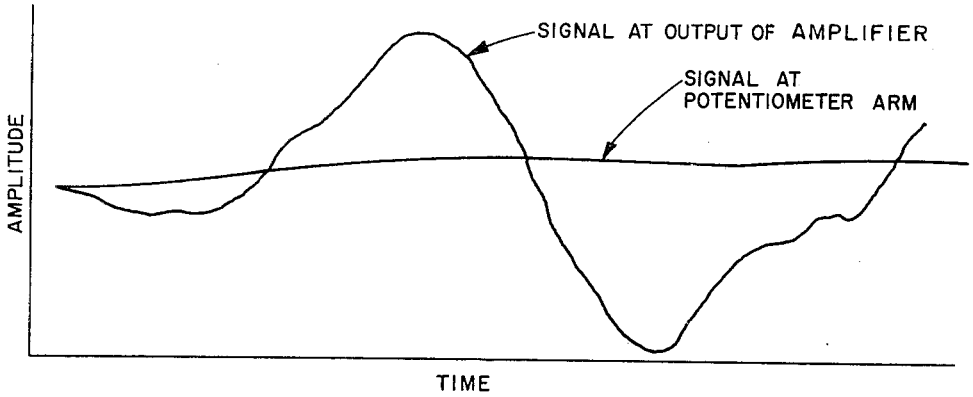
FIG. 4 is a graphic representation and comparison of the output signal obtained from the amplifier and from the potentiometer.

With reference now to FIG. 2, there is represented by way of example for a torpedo acoustic homing system the operation of the potentiometer arm 14 wherein the abscissa axis is target angle, zero being coincident with the longitudinal axis of the torpedo, all angles to the left being considered negative and all angles to the right being considered positive; and the ordinate axis is potentiometer arm positions, zero being approximately the electrical midpoint of the potentiometer 12. The operation of the potentiometer arm 14 for various signal-to-noise ratios is shown from the limiting condition of $S/N = \infty$ to $S/N < 1$, where S/N is the signal-to-noise ratio. For substatially all cases of S/N equal to or greater than 1, the rotation of the potentiometer arm 14 is linear for plus or minus small target angles and becomes non-linear for greater plus or minus target angles. For signal-to-noise ratios less than 1, the rotation of the potentiometer arm is substantially sinusoidal.

Figure 3:
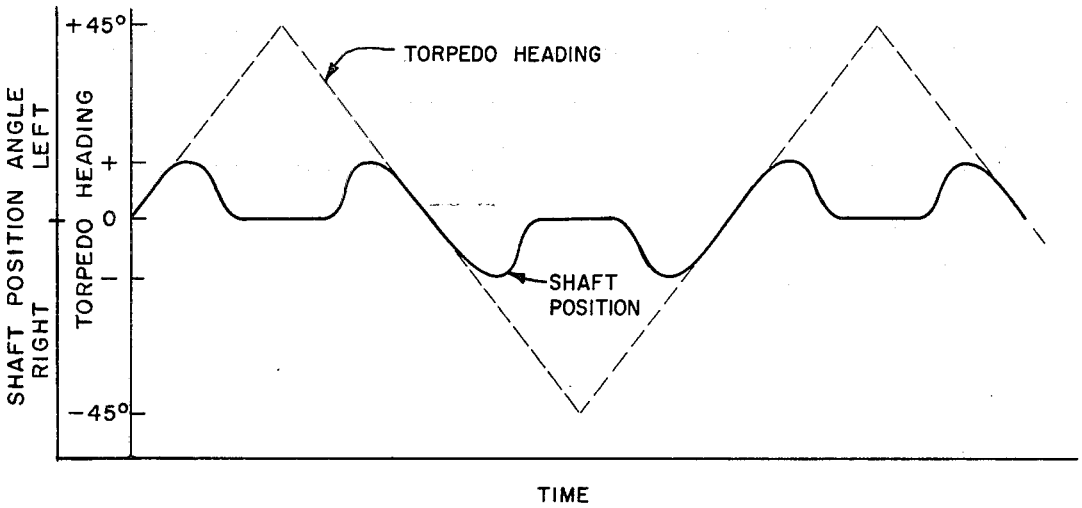
FIG. 3 is a graphic representation by way of example of the general relation of a potentiometer shaft position and torpedo heading relative to time.

With reference now to FIG. 3 if a target is swept at a constant rate, for example, from 0° to +45° to −45°, the potentiometer arm 14 will move from its midpoint position as shown in FIG. 1 to some negative position dependent upon the signal-to-noise ratio, back to its midpoint position and will remain at substantially this position until the hydrophone again begins looking at the target on the back sweep at which time the potentiometer arm 14 will again move to some negative position and pass through its midpoint position at zero target angle and continue in a positive direction to some positive position as determined by the signal-to-noise ratio and again return to its midpoint position as the torpedo sweeps completely past the target. As the torpedo again sweeps toward the target the potentiometer arm 14 will move in a positive direction to a maximum positive position, from there to its midpoint position at zero target angle, and then continue its movement as described immediately hereinbefore.

Inspection of FIG. 3 will show that as the target angle approaches zero from either direction the function of the potentiometer arm 14 for a given signal-to-noise ratio approximates a sine wave that will not only allow the determination of a detectable target but will also allow determination of the direction of the target with reference to the longitudinal axis of the torpedo.

For the special case as described herein of the hydrophone having a split beam and sum and difference patterns wherein a difference pattern is disposed to the right and a difference pattern is disposed to the left of the longitudinal axis of the sum pattern, the output function of the target angle measuring panel 11, which is to say the potentiometer arm 14, has the characteristic as shown in FIG. 3. Briefly, the dual but separate negative and positive excursions of the potentiometer arm 14 are due to the hydrophone pattern characteristics. As the torpedo moves in one direction from, for example zero target angle, the action of the sum pattern and one difference pattern causes an excursion of the potentiometer arm 14 from zero (or midpoint position) to a maximum position and back to zero again. As the same difference pattern and the sum pattern are swept back toward the target, another similar excursion of the potentiometer arm results; and as the other difference pattern and the sum pattern are swept across the target a similar excursion of the potentiometer arm is caused except that it is in the opposite direction.

In actual practice the frequency at which a target can be swept must be a relatively low frequency in order to allow a sufficient volume of space or water to be searched. A satisfactory rate for a torpedo has been determined to be 10° per second for ± 45° from the zero reference. Under normal operating conditions, the potentiometer arm 14 will contain "jitter" or noise having a period ($\tau$) substantially equal to the period of the potentiometer arm during detection of a target. Still further, the power spectrum of the desired signal, which is to say the first function of potentiometer arm movement during detection of a target, lies within the power spectrum of the noise or undesirable components of the output signal of the target angle measuring panel. It is for this reason that movement of the potentiometer arm alone cannot be used at great ranges for detection of a target because the signal-to-noise ratio is less than one; hence gating would occur on noise alone.

In view of the discussion of FIG. 2, it may now be apparent that irrespective of the type of searching means used the first function of the output signal of the target angle measuring panel during detection of a target will have a specific and predetermined period as modified by noise and that the first function of the output signal during detection of a target will have a specific and predetermined power spectrum which spectrum will lie within the power spectrum of the noise or undesired components.

Figure 6:
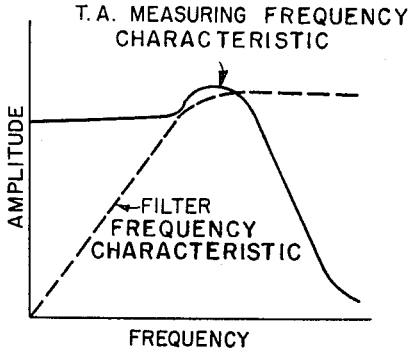
FIG. 6 illustrates how the frequency characteristic of a target angle measuring panel is combined with the frequency characteristic of a filter to obtain a signal at the output terminals of the filter having substantially the same power spectrum as that of the desired signal of the potentiometer shaft.

It is the function and purpose of filter 21 to form a simple high-pass filter which when used in conjunction with the low-pass frequency characteristic of panel 11, results in a total frequency characteristic similar to that of a band-pass filter. Referring now to FIG. 6, the inherent frequency response of panel 11 transmitted to potentiometer arm 14 is similar to that of a low-pass filter. Filter 21, a simple high-pass filter has the conventional characteristic, (FIG. 6, dotted line). The frequency characteristic of panel 11 and filter 21 operating in conjunction with one another, is similar to that of the band-pass filter indicated. That is, signal frequencies transmitted from panel 11 through filter 21 via potentiometer arm 14 resemble those of a band-pass filter. Filter 21 also isolates amplifier 18 from the source of direct current 13 thus eliminating the disadvantageous effects of drift.

Figure 5:
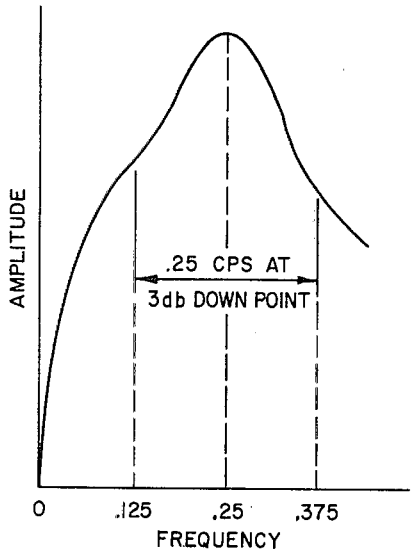
FIG. 5 shows the spectrum of a desired signal from the potentiometer shaft during detection of a target.

FIG. 5 shows, by way of example, a preferred frequency spectrum of the signal at the output terminal of the filter and the approximate frequency spectrum of the first function of the potentiometer arm during detection of a target. The frequency content of the potentiometer arm due to detection of a target is centered around the period ($\tau$) of the wave form as shown in FIG. 2 and has a center frequency of about 0.25 cycles per second and a bandwidth of about 0.25 cycles per second at the 3 db downpoints.

The target-angle measuring panel 11 described has inherent in its conception the frequency characteristic similar to that of a low-pass filter (see solid line on FIG. 6). This effectively excludes or cuts off the transmission of the higher frequencies. Filter 21 is a simple R-C high-pass filter having a characteristic indicated by the broken line of FIG. 6. The effect, therefore, of the combined frequency characteristics of panel 11 and filter 21 is to produce a filter characteristic similar to that produced by a band-pass filter.

It should be noted that the frequency characteristics of the filter 21 may vary considerably depending on the frequency characteristics of panel 11. Filter 21's frequency characteristic is always such that when operated in conjunction with panel 11, the resultant frequency characteristic is similar to that of a band-pass filter of the proper spectrum. If panel 11 had no frequency characteristic, low-pass filter 11 would be replaced by a conventional band-pass filter of selected spectrum. Obviously, for a different target angle measuring panel band-pass a different filter band-pass will be necessary to result in the approximate desired frequency spectrum which may be otherwise than as shown herein.

While the method and means as described herein were developed for application in a torpedo acoustic homing system, the fundamental principles can be applied and will be advantageous generally where a signal-to-noise ratio is less than one or where a power spectrum of the desired signal lies within the power spectrum of the total signal.

Although this invention is described in connection with a particular application, it will be seen that it lies principally in a method and means for filtering and that the environmental torpedo homing apparatus is merely included to provide a background for the explanation of this particular application.

Modifications of the particular embodiment illustrated and described will readily occur to those skilled in the art. It should be understood, therefore, that the invention is not limited to the particular arrangement disclosed, but that the appended claims are intended to cover all modifications which do not depart from the true spirit and scope of the inventions.

I claim:

1. In a detection system for torpedoes providing a first output signal dependent upon target direction relative to the torpedo wherein the target is swept at least initially the combination comprising: movable means actuated by said first output signal for providing an output function proportional to target angle from a reference and to signal-to-noise ratio and having a predetermined power spectrum during the time the target is being swept; first means actuated by said movable means for producing a varying electric signal proportional to said output function; filter means for receiving said varying electric signal and having a fixed high pass for passing substantially only those frequencies within said power spectrum thereby to filter substantially all undesirable noise signals and amplifier means connected to said filter means for receiving the output thereof; and amplitude detector means connected to the output of said amplifier means to gate upon the reception of a pre-determined level of signal.

2. The combination as described in claim 1 wherein said movable means includes a servo-motor circuit actuated by said first output signal to cause the servo-motor to rotate in a direction determined by the target angle from a reference and by an amount proportional to the signal-to-noise ratio of said first output signal.

3. The combination as described in claim 2 wherein said first means includes a source of direct current; a potentiometer connected across said source of direct current and having a movable arm; and means operationally connecting said arm and said servo-motor.

4. The combination as described in claim 3 wherein said filter includes a capacitor connected in series with said potentiometer arm to block said D.C. current from said filter thereby to render the filter substantially insensitive to D.C. drift of the potentiometer arm.

* * * * *